United States Patent [19]

Peters

[11] 4,322,082

[45] Mar. 30, 1982

[54] SPINNING TARGET ASSEMBLY FOR PINBALL GAME

[75] Inventor: Albin Peters, Chicago, Ill.

[73] Assignee: Wico Corporation, Niles, Ill.

[21] Appl. No.: 222,366

[22] Filed: Jan. 5, 1981

[51] Int. Cl.[3] ..... A63B 67/14

[52] U.S. Cl. ..... 273/127 D; 200/61.11

[58] Field of Search ..... 273/127 D, 127 R, 121 A; 200/61.11, 61.1

[56] References Cited

U.S. PATENT DOCUMENTS

| | | | |
|---|---|---|---|
| 650,948 | 6/1900 | Nelson | 273/127 D |
| 3,430,959 | 3/1969 | Ross et al. | 273/127 D |
| 4,235,438 | 11/1980 | Hally | 273/127 D |

OTHER PUBLICATIONS

"Wico Catalog Sheet for B-7875 Spinning Target Assembly".

*Primary Examiner*—George J. Marlo

*Attorney, Agent, or Firm*—Dithmar, Stotland, Stratman & Levy

[57] ABSTRACT

A spinning target assembly for a pinball game includes a molded one-piece frame having a base adapted to be secured to the underside of the playfield board and two spaced-apart upright posts which project through complementary openings in the playfield board and extend a predetermined distance thereabove. A spinner is rotatably mounted between the posts and includes a shaft having an offset central portion which is encapsulated in a molded plastic target. One end of the shaft has secured thereto a cam received in a recess in the top of one post for camming engagement with a connecting rod which extends downwardly through a longitudinal bore in the one post for actuation of the contacts of a switch mounted on the base, and the other end of the shaft is rotatably received in a radial bore in the other post. A cap is removably latched to the top of the one post to retain in place the cam and the associated end of the shaft.

16 Claims, 10 Drawing Figures

SPINNING TARGET ASSEMBLY FOR PINBALL GAME

BACKGROUND OF THE INVENTION

The present invention relates to a target assembly for pinball games, and more particularly, to a target assembly of the type which includes a target member mounted between two posts for rotation about a horizontal axis. The target is dimensioned and arranged so that, in the rest position thereof, it is engageable by a pinball rolling between the two posts to spin the target about the horizontal axis and actuate associated indicating and/or scoring means.

Prior spinning target assemblies have comprised numerous parts which required time-consuming and complicated assembly on the playfield board of the pinball game. More particularly, such prior spinning target assemblies included two multi-part post assemblies individually mountable on the playfield board which were spanned by a U-shaped bracket, between the arms of which a multi-part metal spinning target was mounted. A crank mechanism interconnected the target shaft and the contacts of a switch assembly which was independently mounted beneath the playfield board.

In addition to the complicated initial assembly of these prior devices, servicing thereof and replacement of parts was also quite cumbersome. Thus, in order to replace the spinner, it was necessary to remove two screws to demount the U-shaped bracket from the post assemblies and, if it was desired to change the crank mechanism, it was necessary to have access to both the top and bottom surfaces of the playfield board.

Furthermore, the prior devices required the stocking of a large number of individual parts.

SUMMARY OF THE INVENTION

The present invention provides an improved spinning target assembly which avoids the disadvantages of the prior art assemblies while affording additional structural and operating advantages.

It is a general object of the present invention to provide an improved spinning target assembly which has a minimal number of parts and can be quickly and easily mounted on the playfield board.

It is another object of this invention to provide a spinning target assembly of the type set forth, wherein the spinning target member and the switch-actuating linkage can be replaced entirely from above the playfield board and without the use of tools.

It is another object of this invention to provide a spinning target assembly of the type set forth, which provides a cam-type switch actuating mechanism of simple and economical construction.

These and other objects of the invention are attained by providing a spinning target assembly for a pinball game having a playfield board on which a pinball rolls, the target assembly comprising an integral one-piece frame member having two substantially parallel spaced-apart post portions interconnected only adjacent to one end thereof by a base portion, the frame member being mountable on the associated playfield board with only the distal ends of the post portions extending above the playfield board, and a target member carried by the post portions therebetween and above the playfield board for rotation about a horizontal axis, the target member having a normal rest position in which it is engageable by an associated pinball rolling between the post portions for spinning the target member about the axis.

The invention consists of these and other novel features and a combination of parts hereinafter fully described, illustrated in the accompanying drawings, and particularly pointed out in the appended claims, it being understood that various changes in the details may be made without departing from the spirit, or sacrificing any of the advantages, of the invention.

DESCRIPTION OF THE PREFERRED EMBODIMENT

Figure 1:
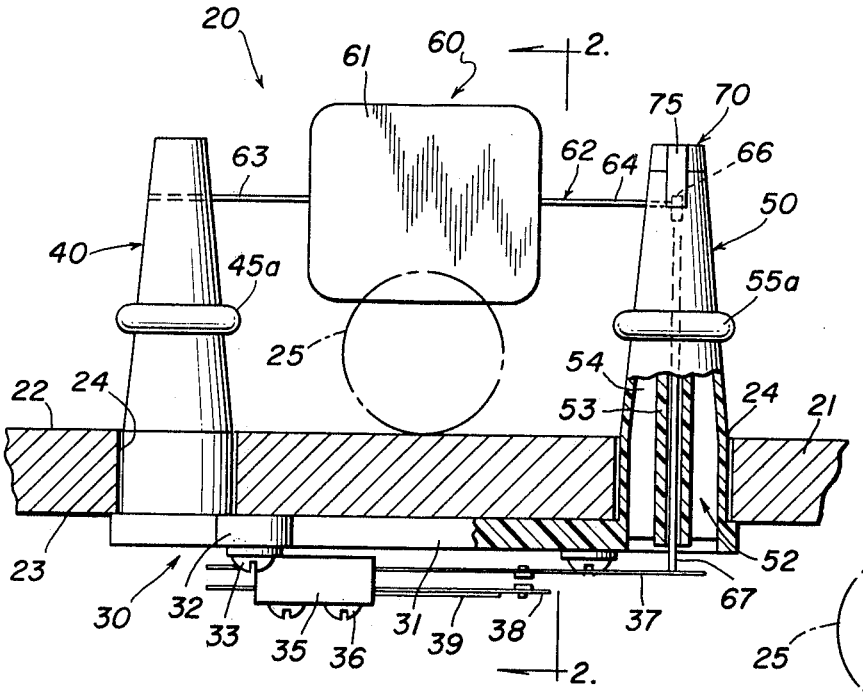
FIG. 1 is a front elevational view in partial vertical section of a spinning target assembly constructed in accordance with and embodying the features of the present invention, shown mounted in position on the playfield board of the pinball game.

Referring to FIG. 1 of the drawings, there is illustrated a spinning target assembly, generally designated by the numeral 20, constructed in accordance with and embodying the features of the present invention and adapted to be mounted on the playfield board 21 of the pinball game. The playfield board 21 has a top surface 22 and a bottom surface 23 and is provided with cylindrical holes 24 therethrough. In use, a pinball 25 rolls along the top surface 22 of the playfield board 21 in a well-known manner.

Figure 2:
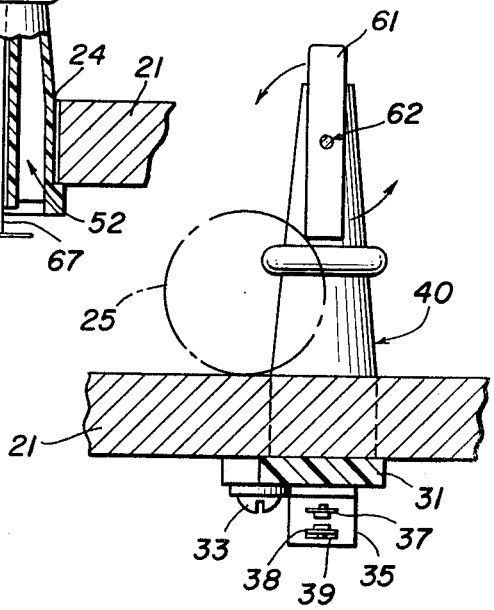
FIG. 2 is a view in vertical section taken along the line 2—2 in FIG. 1.
Figure 5:
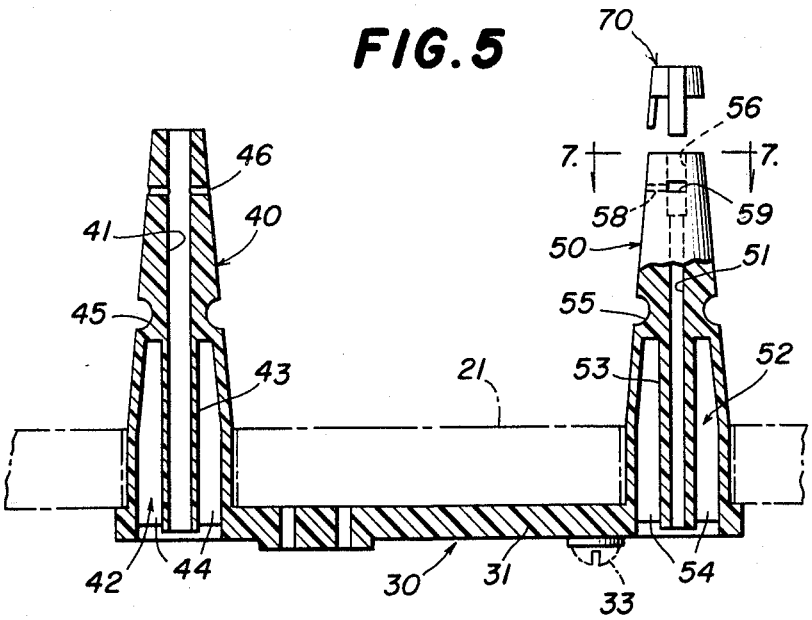
FIG. 5 is a vertical sectional view of the frame of the spinning target assembly of FIG. 1, and illustrating the associated post cap.
Figure 6:
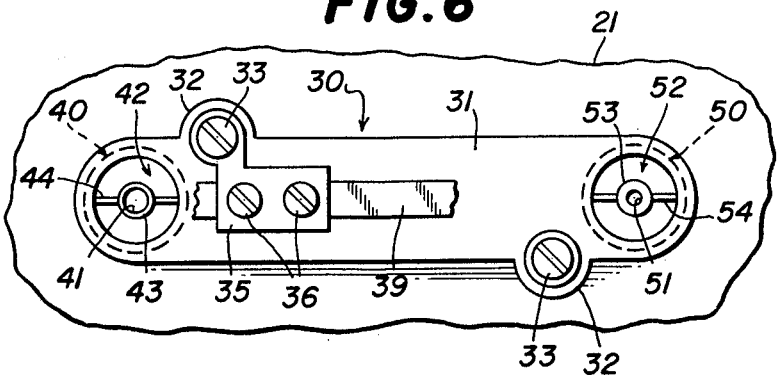
FIG. 6 is a bottom plan view of the spinning target assembly of FIG. 1, with a portion of the switch mechanism broken away more clearly to illustrate the construction.
Figure 10:
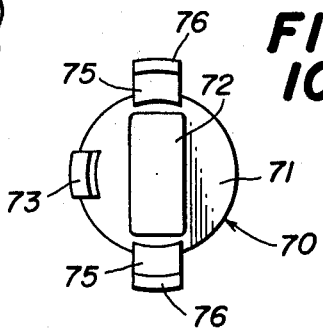
FIG. 10 is a bottom plan view of the cap illustrated in FIG. 9.

Referring now also to FIGS. 2, 5 and 6 of the drawings, the spinning target assembly 20 includes an integral one-piece frame, generally designated by the numeral 30, which is preferably molded of a suitable plastic material. The frame 30 includes an elongated base 31 having part-circular attachment ears 32 projecting therefrom, each of the ears 32 having a cylindrical hole therethrough for receiving an associated fastener 33, such as a screw or the like, for securing the base 31 to the bottom surface 23 of the playfield board 21. An electrical switch 35 is fixedly secured to the bottom of the base 31, as by screws 36, the switch 35 having an upper, relatively long contact arm 37 and a lower, relatively short contact arm 38 supported by an underlying support arm 39, all for a purpose to be explained more fully below.

Integral with the base 31 respectively adjacent to the opposite ends thereof and extending upwardly therefrom respectively through associated ones of the holes 34 in the playfield board 21 are two elongated cylindrical posts, generally designated by the numerals 40 and 50. Each of the posts 40 and 50 has a circularly cylindrical outer surface at the lower end thereof, with the portions of the posts extending above the playfield board 21 being substantially frustoconical in shape, the post 50 being slightly shorter than the post 40, for a purpose explained more fully below.

The post 40 has a cylindrical bore 41 extending longitudinally axially therethrough. The post 40 has a generally annular recess 42 formed in the bottom thereof and extending upwardly thereinto approximately half the length thereof, the remaining material between the bore 41 and the recess 42 forming a tubular wall 43 connected by support webs 44 to the outer wall of the post 40 (see FIG. 5). Formed in the outer surface of the post 40 above the upper end of the recess 42 is a circumferential groove 45 for seating therein an annular resilient bumper 45*a*. Extending radially through the post 40 a predetermined distance from the distal end thereof is a cylindrical bore 46.

The post 50 is slightly different in construction from the post 40. More specifically, the post 50 has a cylindrical bore 51 extending longitudinally axially therethrough, but of a substantially smaller diameter than the bore 41. The bottom of the post 50 has a generally annular recess 52 formed therein extending thereinto approximately half the length thereof. The remaining material between the bore 51 and the recess 52 forms a tubular wall 53 which is connected by support webs 54 to the outer wall of the post 50. Formed in the outer surface of the post 50 above the upper end of the recess 52 is a circumferential groove 55, for seating therein an annular, resilient bumper 55*a*.

Figure 7:
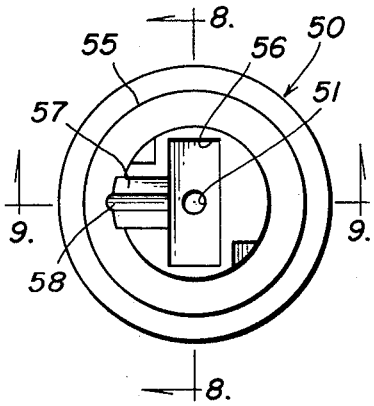
FIG. 7 is an enlarged top plan view of one of the post portions of the frame, taken along the line 7—7 in FIG. 5.
Figure 8:
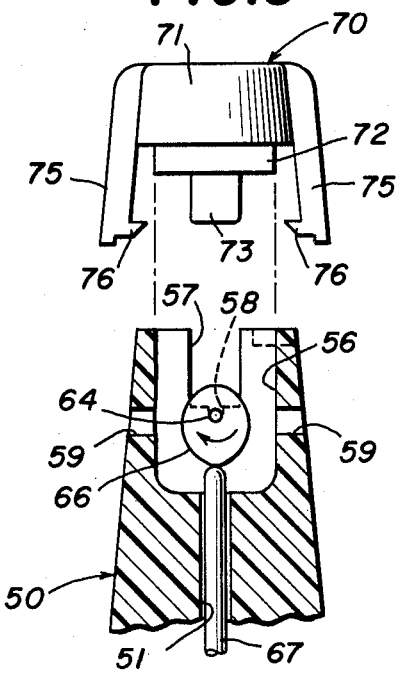
FIG. 8 is a fragmentary view in vertical section of the post portion of FIG. 7, taken along the line 8—8 therein, and additionally illustrating the relationship of the associated cap.
Figure 9:
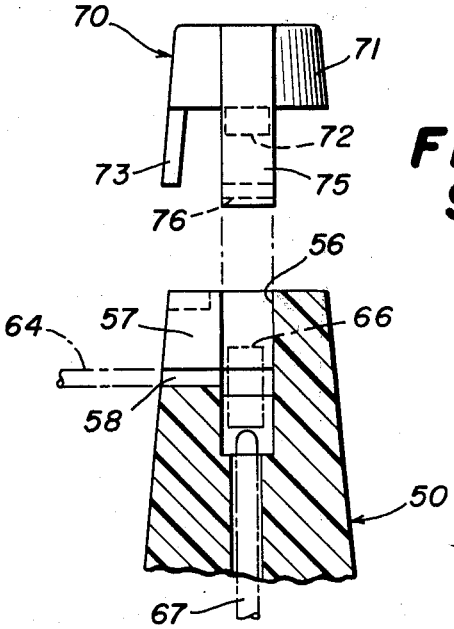
FIG. 9, is a fragmentary view in vertical section of the post of FIG. 7, taken along the line 9—9 therein, and illustrating the relationship of the associated cap.

Referring also to FIGS. 7 through 9 of the drawings, the post 50 has a generally rectangular recess formed centrally in the top thereof and extending longitudinally downwardly therefrom a predetermined distance and communicating with the bore 51. Formed in the side wall of the post 50 at the top or distal end thereof and in the side thereof facing the post 40 is a generally rectangular notch 57 which communicates with the recess 56, but extends downwardly only about half the depth of the recess 56. The notch 57 has a part-cylindrical bearing portion 58 formed centrally of the bottom wall thereof substantially coaxially with the bore 46 and the post 40. Two apertures 59 are respectively formed in the post 50 substantially 90° in opposite directions circumferentially from the center of the notch 57 and spaced from the top of the post 50 a distance approximately equal to the depth of the notch 57.

Figure 3:
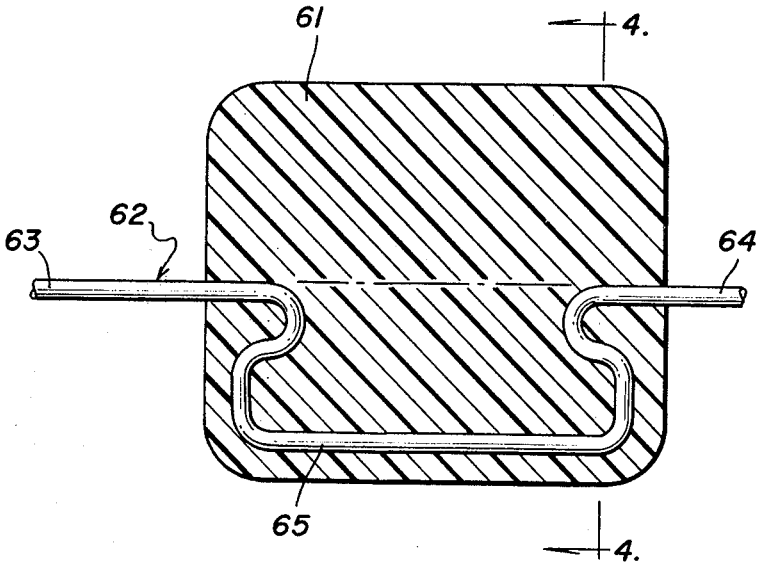
FIG. 3 is an enlarged fragmentary view in vertical section of the spinning target member of the present invention.
Figure 4:
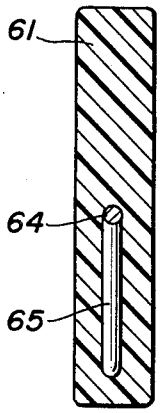
FIG. 4 is a view in vertical section taken along the line 4—4 in FIG. 3.

Referring now also to FIGS. 3 and 4 of the drawings, the spinning target assembly 20 also includes a spinner, generally designated by the numeral 60, which includes a rectangular target body 61 rotatably mounted between the posts 40 and 50 by a shaft generally designated by the numeral 62. The opposite ends 63 and 64 of the shaft 62 are substantially coaxial and respectively extend from the opposite ends of the target body 61. A central portion 65 of the shaft 62 is embedded within the target body 61 and is displaced from the axis of the shaft ends 63 and 64. Fixedly secured to the end 64 of the shaft 62 eccentrically with respect thereto is a generally oval-shaped cam 66.

In use, the end 63 of the shaft 62 is inserted into the bore 46 and the end 64 of the shaft 62 is dropped into the notch 57 from thereabove. The spinner 60 then rests in a mounted position illustrated in FIG. 1, with the shaft end 64 seated in the bearing portion 58 of the notch 57, and with the cam 66 disposed in the recess 56. A connecting rod 67 is disposed in the bore 51 of the shaft 62 with the lower end thereof resting upon the distal end of the upper switch contact arm 37, and with the upper end thereof disposed in camming engagement with the cam surface of the cam 66. It will be appreciated that, as the spinner 60 rotates about the axis of the shaft ends 63 and 64, the cam 66 drives the connecting rod 67 in a vertical reciprocating motion, thereby deflecting the upper switch contact arm 37 into and out of contact with the lower switch contact arm 38 for repeatedly actuating the switch 35.

Referring in particular to FIGS. 1, 5 and 8 through 10 of the drawings, the post 50 is provided with a cap, generally designated by the numeral 70, which has a generally frustoconical body 71, provided centrally of the lower surface thereof with a depending generally rectangular plug 72. Integral with the body 71 and depending therefrom at the perimeter thereof is a generally rectangular retaining arm 73. Also integral with the body 71 and at diametrically opposed points thereon respectively spaced about 90° circumferentially from the retaining arm 73 are two resilient latch arms 75, each extending downwardly a predetermined distance beyond the distal end of the retaining arm 73. Each of the latch arms 75 is provided adjacent the distal end thereof with a radially inwardly extending latch finger 76.

The installation and operation of the spinning target assembly will now be described. It will be understood that the frame 30, including the base 31 and posts 40 and 50, is an integral one-piece structure to which the switch 35 is preassembled to form a unit which is mounted on the playfield board 21 from therebelow. Thus, the posts 40 and 50 are inserted through the corresponding holes 24 in the playfield board 21 and the base 31 is secured to the playfield board 21 with fasteners 33. The connecting rod 67 may be inserted into the bore 51 either before or after mounting of the frame 30 on the playfield board 21. Next, the bumpers 45*a* and 55*a* are fitted over the tops of the posts 40 and 50 and seated respectively in the grooves 45 and 55. Then, the spinner 60 is mounted in place by inserting the shaft end 63 into the bore 46 and dropping the shaft end 64 in the bearing portion 58 of the notch 57, as described above, with the cam 66 disposed in the recess 56.

Finally, the cap 70 is mounted in place in its retaining position, illustrated in FIG. 1. In this regard, the plug 72 is dimensioned to fit into the top of the recess 56 and the retaining arm 73 is dimensioned to fit in the notch 57. The latch arms 75 are resiliently spread slightly so as to slide down along the outer surface of the post 50 until the latch fingers 76 respectively snap into engagement in the side apertures 59 to latch the cap 70 in its retaining position. It will be appreciated that, in this retaining position, the plug 72 and the retaining arms 73 are respectively engageable with the cam 66 and the shaft end 64 to present upward movement of the shaft 62 from the post 50, the length of the shaft 62 being such as to prevent lateral movement thereof from its mounted position. The height of the body 71 is such that when the cap 70 is mounted in its retaining position on the post 50, its top surface is at the same height above the playfield board 21 as is the top of the post 40.

The displacement of the central portion 65 of the shaft 62 from the axis of rotation thereof serves to weight the spinner 60 so that it will always come to rest in the vertical orientation illustrated in FIGS. 1 through 3 of the drawings. The dimension of the target body 61 is such that when it is in its rest position, it is spaced from the top surface 22 of the playfield board 21 and from the posts 40 and 50 by distances less than the diameter of the pinball 25. Thus, it will be understood that when a pinball 25 rolls between the posts 40 and 50 it will engage the target body 61, causing the spinner 60 to spin about the axis of the shaft 62, the resulting rotation of the cam 66 causing a cammed actuation of the switch 35 through the connecting rod 67 in the manner described above. The bumpers 45*a* and 55*a* serve to protect the posts 40 and 50 from impacts of the pinball 25 thereon.

It is a significant feature of the present invention that the cap 70 can be removed by simply manually spreading the latch arms 75 and lifting the cap 70 from its retaining position. Thus, the spinner 60 can be replaced or serviced from above the playfield board 21 without the use of any tools. It will be appreciated that while the cam 66 has been disclosed as having a shape to effect one closure of the switch contact arms 38 and 39 for each revolution of the spinner 60, the cam 66 could have other shapes to effect more than one closure of the switch contacts for each rotation of the spinner 60.

In a constructional model of the present invention, the frame 30 is molded of a polycarbonate material, while the target body 61 and the cam 66 are preferably formed of nylon. In this regard, the target body 61 is molded around the central portion 65 of the shaft 62 so that the central portion 65 is embedded in the target body 61. It will be understood that other plastic materials could be utilized for the target body 61 and the cam 66, but the cam 66 is preferably formed of a self-lubricating material.

From the foregoing, it can be seen that there has been provided an improved spinning target assembly for a pinball game, which assembly is of simple and economical construction and is characterized by ease of assembly on the playfield board of a pinball game. In particular, there has been provided a spinning target assembly in which the spinner can be easily replaced from above the playfield board without the use of tools.

What is claimed is:

1. A spinning target assembly for a pinball game having a playfield board on which a pinball rolls, said target assembly comprising an integral one-piece frame member having two substantially parallel spaced-apart post portions interconnected only adjacent to one end thereof by a base portion, said frame member being mountable on the associated playfield board with only the distal ends of said post portions extending above the playfield board, and a target member carried by said post portions therebetween and above the playfield board for rotation about a horizontal axis, said target member having a normal rest position in which it is engageable by an associated pinball rolling between said post portions for spinning said target member about said axis.

2. The spinning target assembly of claim 1, wherein said frame member is formed of plastic.

3. The spinning target assembly of claim 1, wherein said base portion of said frame member is disposable in use beneath the associated playfield board and is fixedly secured to the underside thereof with said post portions being respectively received through complementary openings in the playfield board.

4. The spinning target assembly of claim 1, and further including switch means, and linkage means interconnecting said switch means and said target member for actuating said switch means in response to rotation of said target member.

5. A spinning target assembly for a pinball game having a playfield board on which a pinball rolls, said target assembly comprising an integral one-piece frame member having two substantially parallel spaced-apart post portions interconnected only adjacent to one end thereof by a base portion, at least one of said post portions having a bore extending longitudinally therethrough, said frame member being mountable on the associated playfield board with only the distal ends of said post portions extending above the playfield board, a target member carried by said post portions therebetween and and adapted to be positioned above the playfield board for rotation about a horizontal axis, said target member having a normal rest position in which it is engageable by an associated pinball rolling between said post portions for spinning said target member about said axis, switch means mounted on said base portion of said frame member, and linkage means disposed in said bore and interconnecting said target member and said switch means for actuating said switch means in response to rotation of said target member.

6. The spinning target assembly of claim 5, wherein said target member includes a shaft having the opposite ends thereof respectively rotatably carried by said post portions, said linkage means including a cam eccentrically carried by said shaft at one end thereof, and a connecting rod disposed in camming engagement with said cam for reciprocating movement thereby in response to rotation of said shaft.

7. The spinning target assembly of claim 6, wherein said one post portion has an enlarged recess in the distal end thereof communicating with said bore, said cam being disposed in said recess.

8. The spinning target assembly of claim 7, and further including retaining means on said one post portion for retaining said cam in position in said recess.

9. The spinning target assembly of claim 5, and further including resilient bumper means respectively encircling said post portions for engagement by associated pinballs impacting on said post portions.

10. The spinning target assembly of claim 5, wherein each of said post portions is substantially cylindrical in shape.

11. A spinning target assembly for a pinball game having a playfield board on which a pinball rolls, said target assembly comprising an integral one-piece frame member having two substantially parallel spaced-apart post portions interconnected only adjacent to one end thereof by a base portion, said frame member being mountable on the associated playfield board with only the distal ends of said post portions extending above the playfield board, one of said post portions having a notch extending longitudinally thereof from the distal end thereof in the side thereof facing the other post portion, said other post portion having a lateral opening therein spaced from the distal end thereof in the side thereof facing said one post portion, and a target member having a shaft, the opposite ends of said shaft being respectively received in said lateral opening and said notch to support said target member between said post portions and above the playfield board for rotation about a horizontal axis, said target member having a normal rest position in which it is engageable by an associated pinball rolling between said post portions for spinning said target member about said axis.

12. The spinning target assembly of claim 11, and further including retaining means carried by said one post portion for preventing removal of said shaft from said post portions.

13. The spinning target assembly of claim 11, wherein said notch is generally rectangular in shape and has a part-cylindrical bearing portion disposed centrally of the lower end thereof for receiving therein the associated end of said shaft.

14. A spinning target assembly for a pinball game having a playfield board on which a pinball rolls, said target assembly comprising an integral one-piece frame member having two substantially parallel spaced-apart post portions interconnected only adjacent to one end thereof by a base portion, said frame member being mountable on the associated playfield board with only the distal ends of said post portions extending above the playfield board, one of said post portions having a notch extending longitudinally thereof from the distal end thereof in the side thereof facing the other post portion, said other post portion having a lateral opening therein spaced from the distal end thereof in the side thereof facing said one post portion, a target member having a shaft, the opposite ends of said shaft being respectively received in said lateral opening and said notch to support said target member between said post portions and above the playfield board for rotation about a horizontal axis, said target member having a normal rest position in which it is engageable by an associated pinball rolling between said post portions for spinning said target member about said axis, and a cap adapted for attachment to the distal end of said one post portion in a retaining position, said cap having a retaining arm disposable in said notch when said cap is in its retaining position for preventing removal of said shaft from said post portions.

15. The spinning target assembly of claim 14, wherein said cap includes latch means engageable with said one post portion for holding said cap in its retaining position thereon.

16. The spinning target assembly of claim 15, wherein said one post portion has two apertures formed therein adjacent to the distal end thereof and respectively adjacent to the opposite sides of said notch, said latch means including two resilient latch arms depending from said cap and each provided with a latch finger engageable in an associated one of said apertures releasably to latch said cap in its retaining position on said one post portion.

* * * * *